US008397346B2

(12) United States Patent
Peters et al.

(10) Patent No.: US 8,397,346 B2
(45) Date of Patent: Mar. 19, 2013

(54) METHODS AND SYSTEMS FOR DEPLOYMENT OF CURTAINS

(75) Inventors: William P. Peters, Weldon Springs, MO (US); Edward H. Ruble, Wentzville, MO (US)

(73) Assignee: ICP Medical, LLC, St. Louis, MO (US)

( * ) Notice: Subject to any disclaimer, the term of this patent is extended or adjusted under 35 U.S.C. 154(b) by 493 days.

(21) Appl. No.: 12/783,050

(22) Filed: May 19, 2010

(65) Prior Publication Data

US 2011/0283479 A1 Nov. 24, 2011

(51) Int. Cl.
*E05D 15/00* (2006.01)

(52) U.S. Cl. ..... 16/87.2; 16/93 D; 16/94 D; 16/95 D; 16/96 D

(58) Field of Classification Search ..... 16/87 R, 16/87.2, 92, 93 D, 94 D, 95 D, 96 D, 105; 160/340, 341, 344
See application file for complete search history.

(56) References Cited

U.S. PATENT DOCUMENTS 3,137,027 A 6/1964 Birkle
3,585,674 A 6/1971 Golden
3,616,486 A 11/1971 Ford et al.
3,638,711 A 2/1972 Mazzarelle
3,779,539 A 12/1973 Ziers
3,936,906 A * 2/1976 Takazawa ..... 16/87.4 R
4,141,105 A 2/1979 Gonon
4,282,630 A 8/1981 Toder
4,525,893 A 7/1985 Fukada
4,675,939 A 6/1987 Fukada
4,688,620 A 8/1987 Lechner et al.
4,793,399 A 12/1988 Pryor
5,217,057 A 6/1993 Hubbard et al.
5,421,551 A 6/1995 LeClaire
5,518,058 A 5/1996 Gastmann
5,544,387 A 8/1996 Yamamoto et al.
5,544,393 A 8/1996 Lightfoot
5,615,461 A 4/1997 Tominaga et al.
5,894,642 A 4/1999 Eberhardt
5,903,957 A 5/1999 Le Manchec
6,189,597 B1 2/2001 Cheng
6,192,965 B1 2/2001 Hinds
6,382,297 B1 5/2002 Takizawa et al.
6,394,168 B1 5/2002 Zoboski
6,564,851 B1 5/2003 Liao
6,618,900 B2 * 9/2003 Spork et al. ..... 16/87 R
7,350,244 B1 4/2008 Handley
(Continued)

OTHER PUBLICATIONS

International Search Report and Written Opinion of PCT/US09/40489; Feb. 3, 2010; 26 pages.

*Primary Examiner* — Roberta Delisle
(74) *Attorney, Agent, or Firm* — Luedeka Neely Group, PC

(57) ABSTRACT

A curtain hanging system is described that includes a curtain rod hanger with an overhead suspension member and a collar with a bellows. The curtain rod hanger includes one or more collar engaging members. When the collar is coupled to the curtain rod hanger via the collar engaging members, the bellows surrounds at least a portion of the curtain rod hanger.

20 Claims, 8 Drawing Sheets

U.S. PATENT DOCUMENTS

2003/0102091 A1 6/2003 Liao
2004/0074613 A1 4/2004 Junger et al.
2006/0266483 A1 11/2006 Roberts et al.
2007/0261803 A1 11/2007 Alexander et al.
2009/0288784 A1* 11/2009 Graneto, III ..... 160/341
2009/0288785 A1* 11/2009 Graneto, III ..... 160/341
2009/0288786 A1* 11/2009 Graneto et al. ..... 160/344
2010/0212845 A1* 8/2010 Graneto III et al. ..... 160/341
2011/0211174 A1* 9/2011 Curtis ..... 353/80
2011/0283479 A1* 11/2011 Peters et al. ..... 16/87.2
2012/0037324 A1* 2/2012 Graneto, III ..... 160/341

* cited by examiner

METHODS AND SYSTEMS FOR DEPLOYMENT OF CURTAINS

BACKGROUND OF THE INVENTION

This invention relates generally to curtains, and more specifically, to methods and systems for deployment of curtains.

Curtains, and more specifically disposable or washable curtains, have long been used, in hospitals for example, to provide privacy, room division, and to a lesser extent, to cover storage areas. Generally, these curtains are suspended from an overhead track on a ceiling for operation. For example, the curtains can be operated to substantially surround a patient's bed for privacy, and retracted at other times when privacy is not an issue.

Known curtain hanging systems include curtain engagement members, such as hooks, which are suspended from and translatable along an overhead track. The curtain engagement members allow a curtain to be suspended from the overhead track and to be moved along the path of the overhead track.

However, known curtain hanging systems suffer from functional shortcomings. For example, in some known systems, curtain engagement members are coupled to each other via linkages, such as chains, to enable a curtain to be extended by pulling on one curtain engagement member and without applying tension to the curtain itself. When the curtain engagement members are positioned proximate to each other, such linkages may become entangled with each other and/or with a curtain engagement member. Known systems may also allow a curtain and/or a curtain engagement member to become decoupled from the overhead track when a lateral and/or upward force is inadvertently applied. Furthermore, known systems may be susceptible to unintended contraction of the curtain, especially when used with a heavy and/or strongly creased curtain.

BRIEF DESCRIPTION OF THE INVENTION

In one aspect, a curtain hanging system is provided. The system includes a curtain rod hanger and a collar. The curtain rod hanger includes an upper end having an overhead suspension member operable to couple the curtain rod hanger to a track engaging component and a lower end opposite the upper end having a curtain rod engaging member. The curtain rod hanger also includes at least one collar engaging member. The collar includes at least one curtain rod hanger engaging member that corresponds to the at least one collar engaging member of the curtain rod hanger and is operable to couple the collar to the curtain rod hanger. The collar further includes a bellows extending from the curtain rod hanger engaging member. When the collar is coupled to the curtain rod hanger, the bellows surrounds at least a portion of the curtain rod hanger.

In another aspect, a curtain hanging system is provided. The curtain hanging system includes an overhead track engaging component that includes a curtain rod hanger suspending member. The system also includes a curtain rod hanger and a collar. The curtain rod hanger includes an overhead suspension member that corresponds to the curtain rod hanger suspending member and is operable to couple the curtain rod hanger to the overhead track engaging component. The curtain rod hanger also includes at least one collar engaging member. The collar includes a bellows, which surrounds at least a portion of the curtain rod hanger when the collar is coupled to the curtain rod hanger via the collar engaging member.

In yet another aspect, a method of assembling a curtain hanging system is provided. The curtain hanging system includes a curtain rod hanger having an upper end, a lower end, and a plurality of collar engaging members at a plurality of positions between the upper end and the lower end. The method includes positioning a collar that includes a bellows about the curtain rod hanger. The curtain rod hanger is attached to a track engaging component that is translatably coupled to a track. The collar is coupled to a first collar engaging member of the plurality of collar engaging members such that the bellows extends to the track.

DETAILED DESCRIPTION OF THE INVENTION

Figure 1:
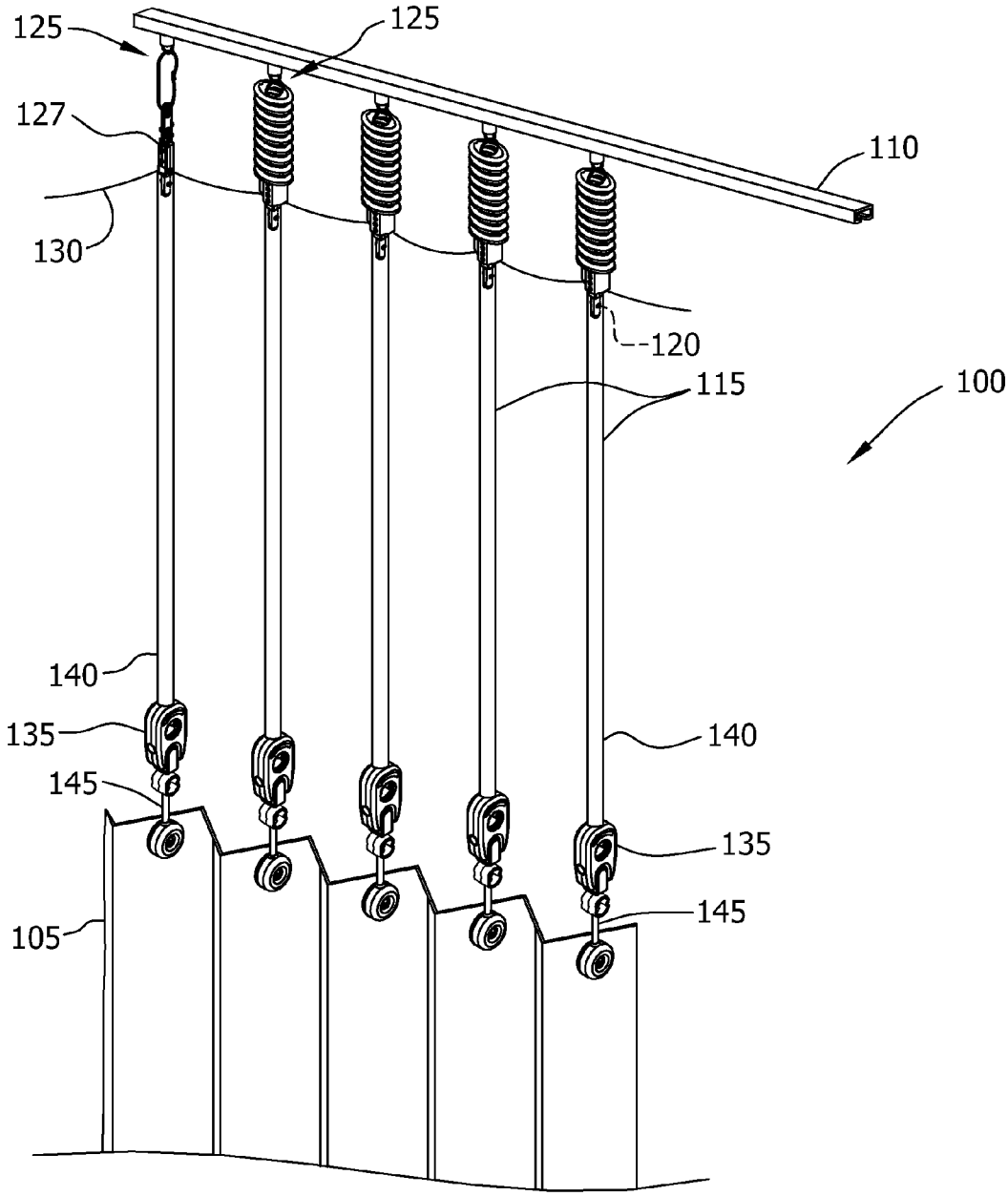
FIG. 1 is an illustration an exemplary curtain hanging system in which a curtain is suspended from an overhead track by a plurality of vertical curtain rods.

FIG. 1 is an illustration of an exemplary curtain hanging system 100 in which a curtain 105 is suspended from an overhead track 110 by a plurality of substantially vertical (e.g., within three or five degrees of vertical) curtain rods 115. Although the overhead track 110 is attached to a ceiling (not shown), embodiments described herein are operable with any overhead sliding track from which the curtain rods 115 may be suspended.

In an exemplary embodiment, the curtain rods 115 extend at an upper end 120 from tracked hooks 125. The upper end 120 of a curtain rod 115 may be coupled to a tracked hook 125 and/or the overhead track 110 by a curtain rod hanger 127. The tracked hooks 125 are capable of translation along the track 110 for the purpose of moving (e.g., expanding, contracting, opening, and/or closing) the curtain 105.

When the curtain 105 is contracted and/or open, the curtain rods 115 are in a position substantially adjacent one another, as further addressed below. This position may also be referred to as having the curtain 105 in a gathered position. When the curtain 105 is expanded and/or closed, the curtain rods 115 are moved from the substantially adjacent position to a configuration where they are substantially spread out along the length of the track 110. This position may also be referred to as having the curtain 105 in a deployed position.

In one embodiment, a linkage 130 extends between the curtain rods 115 and is secured to each of the curtain rods 115. As it is secured to each of the curtain rods 115, linkage 130 operates to dictate a maximum distance between the individual curtain rods 115. For example, the maximum distance may be shorter than the width of the curtain 105 between the curtain rods 115, such that when the curtain rods 115 are drawn apart, tension is applied to the linkage 130 rather than the curtain 105.

The curtain 105 may be removable. In the illustrated embodiment, curtain release mechanisms 135 engage a lower end 140 of the curtain rods 115. Curtain release mechanisms are selectively coupled to curtain engaging members 145, which are coupled to the curtain 105. Such an embodiment facilitates convenient coupling and decoupling of the curtain 105 from the curtain hanging system 100. In some embodiments, curtains are fabricated from either a disposable material or a material that may be reused after a cleaning process.

Figure 2:
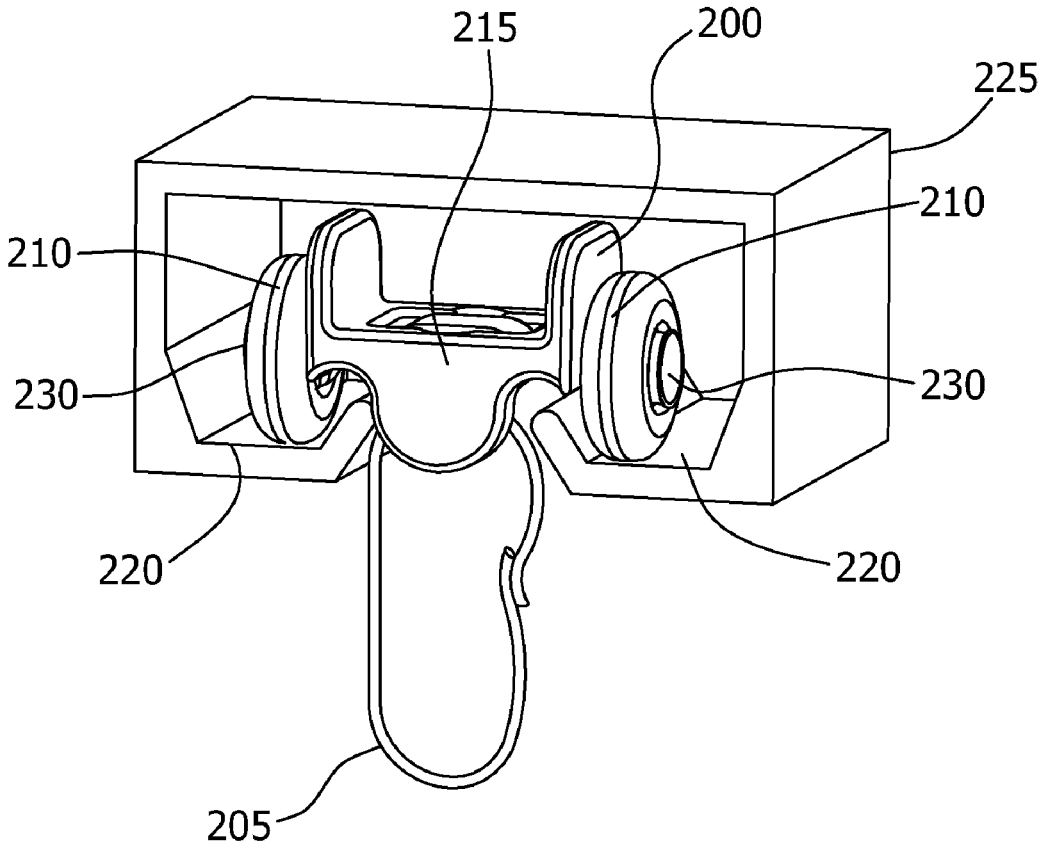
FIG. 2 is an illustration of an exemplary wheeled overhead track engaging component.

FIG. 2 is an illustration of an exemplary wheeled overhead track engaging component 200 with a curtain rod hanger suspending member in the form of a hook 205 extending therefrom for engaging a curtain rod hanger. As shown in FIG. 2, overhead track engaging component 200 includes at least two rollers 210 that extend from an engaging component body 215 and engage (roll along) respective channels 220 within an overhead track component 225. Rollers 210 are rotatable with respect to their attachment to engaging component body 215 to allow overhead track engaging component 200 to move along the channels 220 of the overhead track component 225. In the illustrated embodiment, axles 230 extend from the engaging component body 215 and are configured such that rollers 210 can attach thereto in a snap fit arrangement while still being rotatable with respect to the engaging component body 215.

The hook 205 extends from the engaging component body 215 such that it is positioned between the channels 220. The hook 205 may be rotatable with respect to the engaging component body 215. In operation, a user moving a curtain suspended from the hook 205 effectively rolls the overhead track engaging component 200 along the channels 220 of the overhead track component 225.

Figure 3:
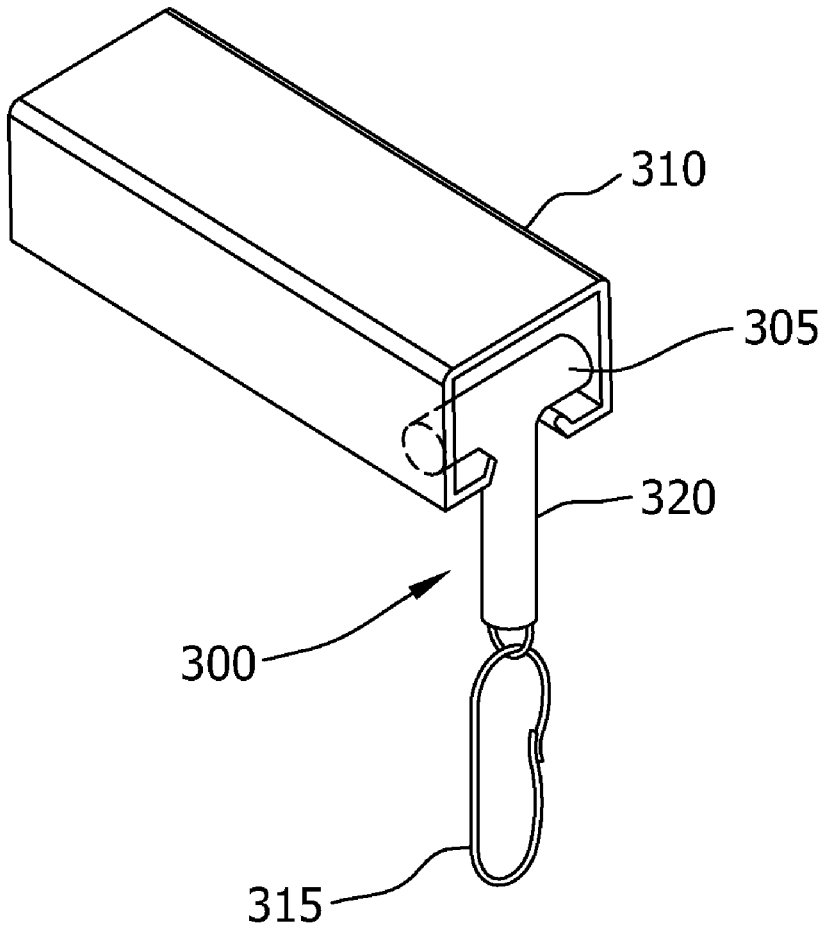
FIG. 3 is an illustration of an exemplary sliding overhead track engaging component.

FIG. 3 is an illustration of an exemplary sliding overhead track engagement component 300. The overhead track engagement component 300 may be useful in locations with relatively low ceilings, such as, without limitation, in front of a closet or pantry. In the illustrated embodiment, the overhead track engaging component 300 is a "T" shaped component, the top 305 of which is configured to extend across and slidably engage an overhead track 310. The overhead track engagement component 300 includes a hook 315 for engaging a curtain rod hanger. In some embodiments, the overhead track engaging component 300 is a "T" shaped component with a top 305 extending horizontally a first length and a leg 320 extending vertically a second length. The second length may be substantially larger than the first length. For example, the second length may be approximately two, three, five, or ten times larger than the first length.

Figure 4:
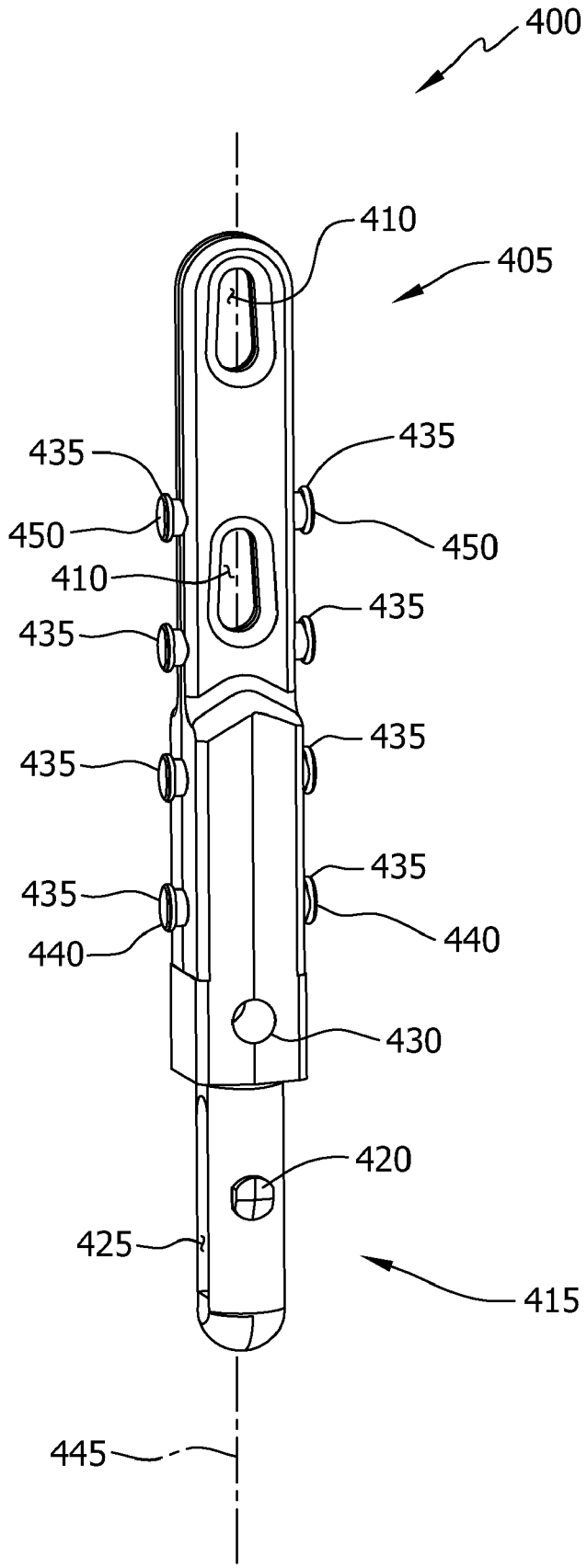
FIG. 4 is an illustration of an exemplary curtain rod hanger.

FIG. 4 is an illustration of an exemplary curtain rod hanger 400. At an upper end 405, the curtain rod hanger 400 includes overhead suspension members corresponding to the curtain rod hanger suspending member of the overhead track and operable to couple the curtain rod hanger 400 to an overhead track engaging component (e.g., as shown in FIGS. 2 and 3). For example, the overhead track engaging component may include a hook, or an overhead suspension member may be configured to be coupled to the overhead track engaging component via a hook.

In an exemplary embodiment, the overhead suspension members are provided in the form of two hook receiving apertures 410. The hook receiving apertures 410 facilitate suspending the curtain rod hanger 400 from an overhead track engaging component, such as shown in FIGS. 2 and 3.

While the curtain rod hanger 400 may include only one overhead suspension member, the inclusion of multiple overhead suspension members in the exemplary embodiment allows the curtain rod hanger to be positioned at varying vertical displacements from an overhead track. For example, each overhead suspension member may be operable to couple the curtain rod hanger 400 to an overhead track at a different vertical distance from the overhead track.

At a lower end 415 opposite the upper end 405, the curtain rod hanger 400 includes one or more curtain rod engaging members operable to couple the curtain rod hanger 400 to a substantially vertical curtain rod having a substantially hollow upper end. In an exemplary embodiment, the curtain rod engaging members are provided in the form of one or more protrusions 420, which may also be referred to as pegs.

As illustrated in FIG. 4, the protrusions 420 are beveled toward the lower end 415 of the curtain rod hanger 400 to facilitate engagement with a curtain rod that has receiving apertures adjacent the hollow upper end that correspond to the protrusions 420. In the exemplary embodiment, the lower end 415 also includes an elongate aperture 425. The elongate aperture 425 may allow the lower end 415 to compress as the protrusions 420 are inserted into the hollow end of a curtain rod and to expand when the protrusions 420 engage the receiving apertures of the curtain rod. In addition, or alternatively, the elongate aperture 425 may function as a hook receiving aperture for engaging a curtain rod with a hook.

The curtain rod hanger 400 also includes a linkage engagement member 430 operable to couple the curtain rod hanger 400 to one or more linkages (shown in FIG. 1). In the illustrated embodiment, the linkage engagement member 430 is a bore extending through the curtain rod hanger 400. In an exemplary embodiment, the linkage engagement member 430 fixably couples the curtain rod hanger 400 to a chain, such as, without limitation, a bead chain. For example, the linkage engagement member 430 may be an aperture through which a bead chain passes and may further have a diameter smaller than a bead diameter that provides a friction fit with the bead chain.

Figure 5:
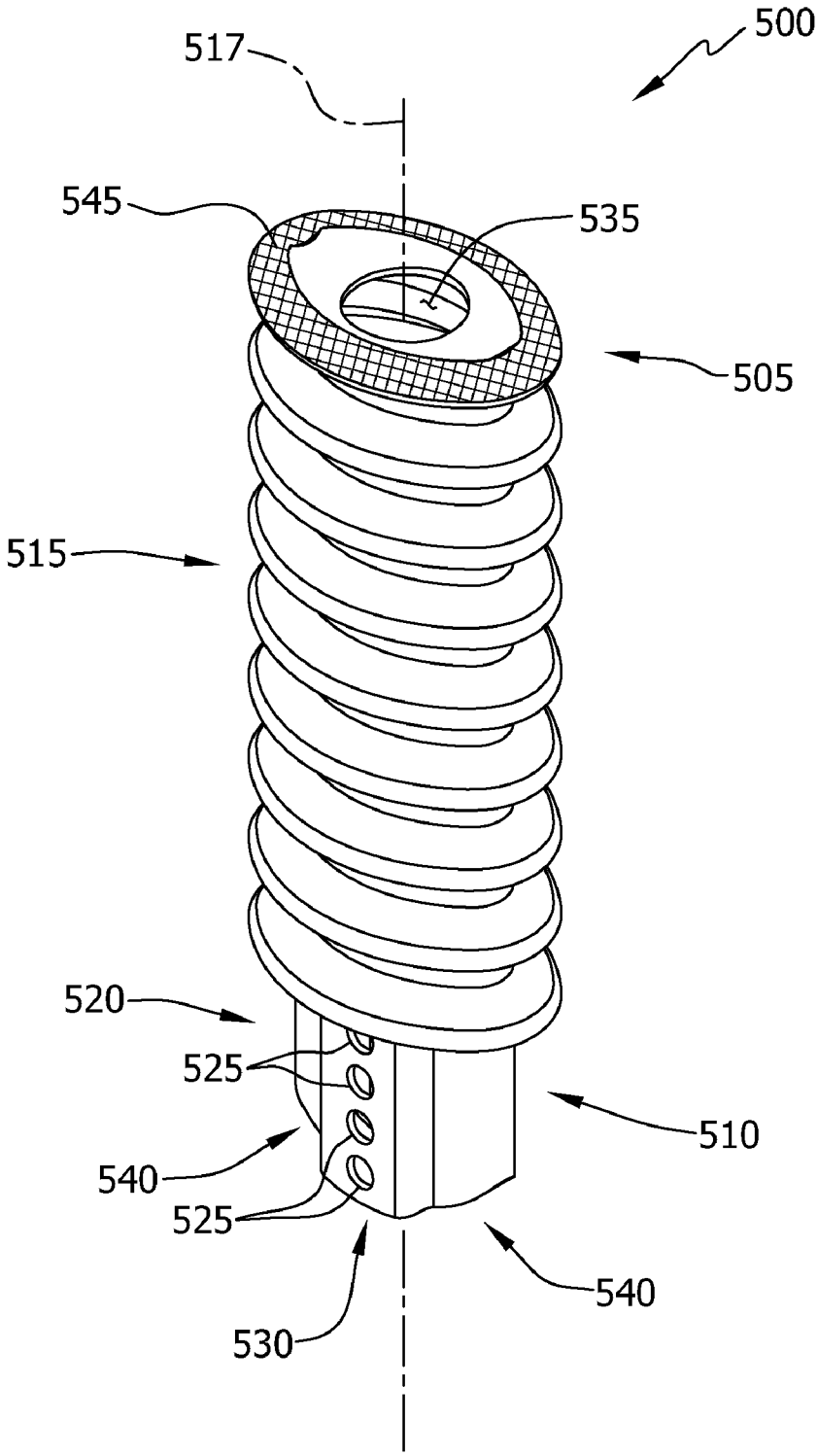
FIG. 5 is an illustration of an exemplary collar for use with the curtain rod hanger shown in FIG. 4.

The curtain rod hanger 400 further includes one or more collar engaging members in the form of protrusions 435. Collar engaging members are operable to couple the curtain rod hanger 400 to a collar, which is shown in FIG. 5.

In the exemplary embodiment, protrusions 435 are arranged in pairs, with each protrusion 435 of a pair extending from opposite faces of the curtain rod hanger 400. For example, a first pair of protrusions 440 are included proximate to the lower end 415 of the curtain rod hanger 400.

Some embodiments facilitate coupling the collar to the curtain rod hanger 400 at varying vertical displacements from an overhead track and/or from the upper end 405. As illustrated in FIG. 4, a longitudinal or vertical axis 445 is defined extending through the upper end 405 and the lower end 415 of the curtain rod hanger 400. Because the curtain rod hanger 400 is configured to be suspended from an overhead track engaging component by one of the hook receiving apertures 410, a position along the vertical axis 445 at or near the upper end 405 is referred to as higher than a position at or near the lower end 415.

The curtain rod hanger 400 includes pairs of protrusions 435 at four positions along the vertical axis 445, with the first pair of protrusions 440 positioned at a lowest vertical position and a second pair of protrusions 450 positioned at a highest vertical position. Any quantity of protrusions 435 or other collar engaging members may be spaced between the upper end 405 and the lower end 415. Further, such collar engaging members may be uniformly or non-uniformly spaced.

While the curtain rod hanger 400 is illustrated with specific types of fasteners and/or engaging members, it is contemplated that the curtain rod hanger 400 may include any form of fasteners and/or engaging members operable with the embodiments described herein. Such fasteners and/or engaging members may include, but are not limited to a hook, a protrusion, a peg, a linkage (e.g., a cable and/or a chain), a receiving aperture, a clip, a snap, a screw, a pin, a clamp, an adhesive, and/or any structure or substance operable to couple one component to another component.

Figure 6:
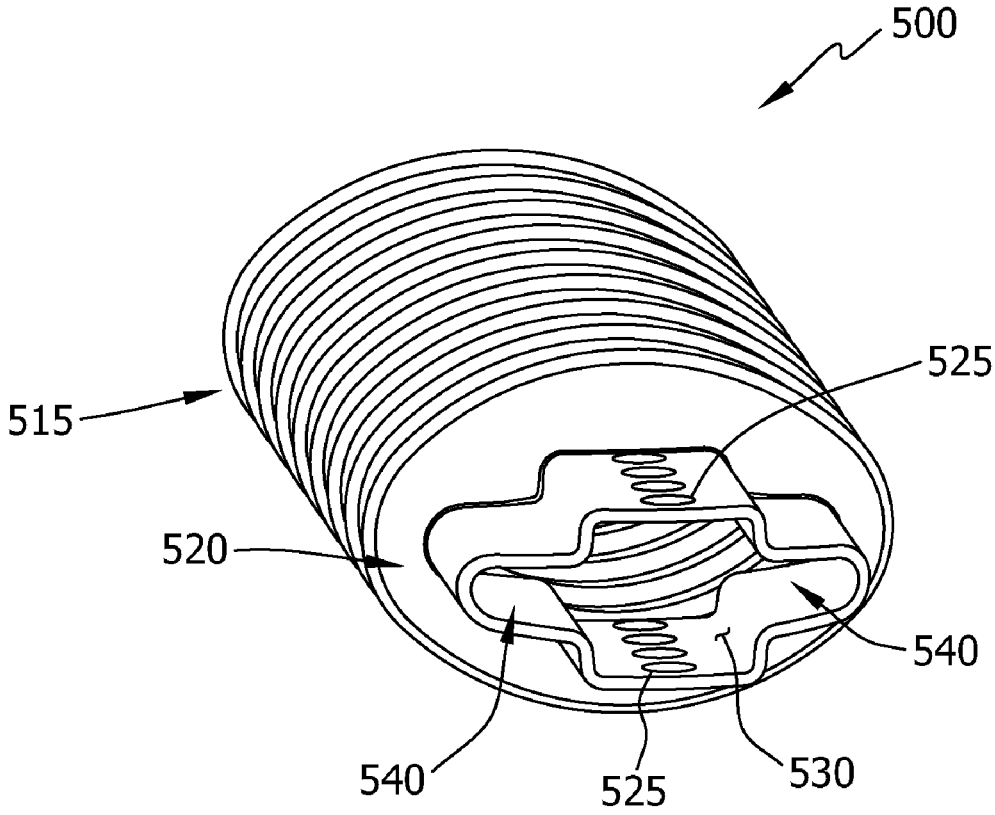
FIG. 6 is an illustration of the collar shown in FIG. 5 from a bottom perspective.
Figure 7:
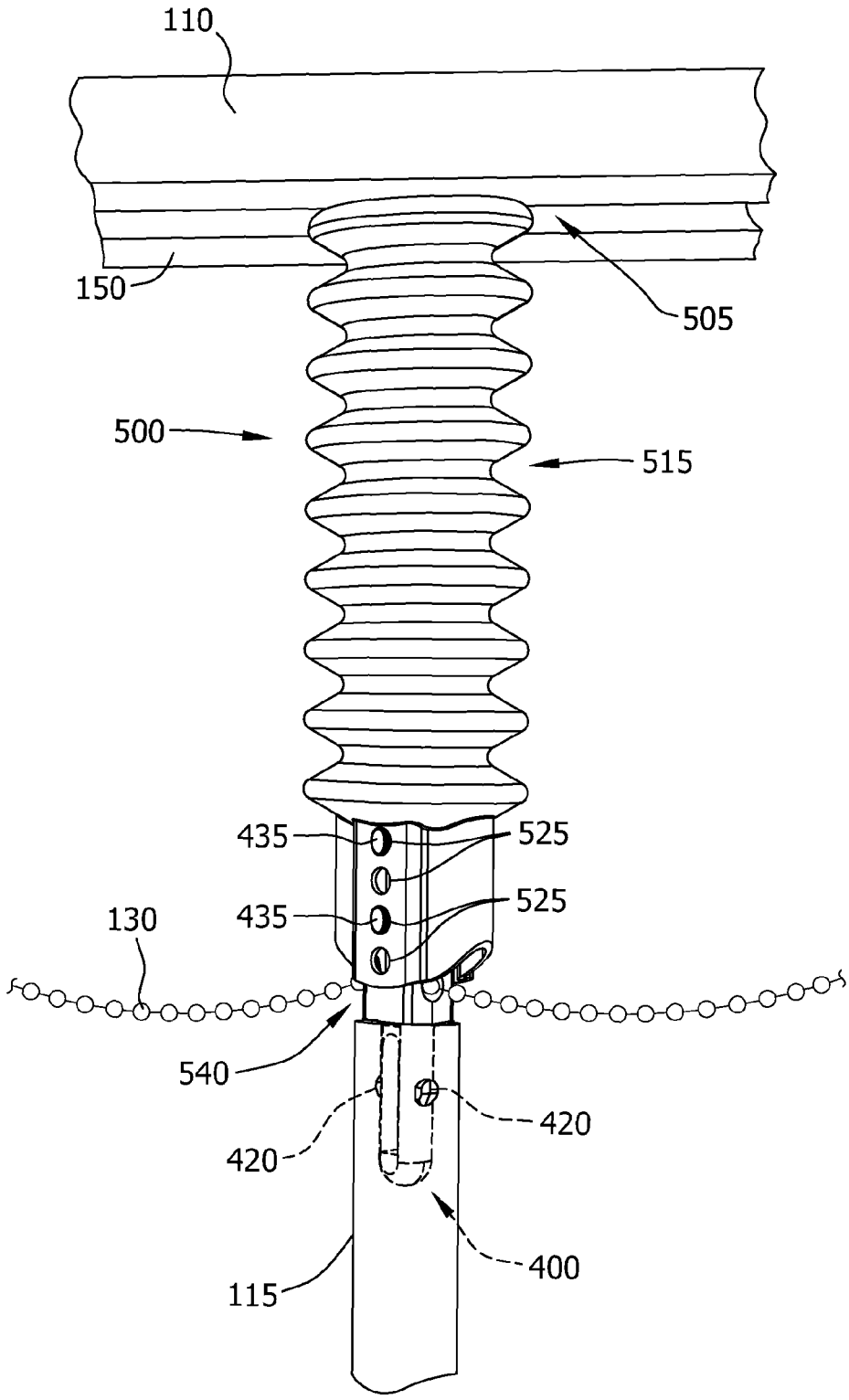
FIG. 7 is an illustration of the collar shown in FIG. 5 coupled to the curtain rod hanger shown in FIG. 4 when the curtain rod hanger is coupled to an overhead track.

FIG. 5 is an illustration of an exemplary collar 500 for use with curtain rod hanger 400 (shown in FIG. 4). FIG. 6 is an illustration of the collar 500 from a bottom perspective. The collar 500 includes an upper end 505 and a lower end 510. The upper end 505 is associated with and/or includes a bellows 515, which extends from a base 520 and/or a collar engaging member at the lower end 510. The bellows 515 is compressible along a vertical axis 517 defined extending through the upper end 505 and the lower end 510. In operation, the collar 500 may be positioned on a curtain rod hanger 400 such that the bellows 515 is compressed between the curtain rod hanger 400 and the overhead track, as shown in FIG. 7. The bellows 515 may be configured to act as a spring, exerting an expansion force when compressed.

The base 520 includes one or more collar engaging members operable to couple the collar 500 to the curtain rod hanger 400. The base 520 may include one or more curtain rod hanger engaging members, which may correspond to collar engaging members of the curtain rod hanger 400. In the exemplary embodiment, the curtain rod hanger engaging members are protrusion receiving apertures 525, each of which is operable to receive a protrusion 435. As shown in FIG. 4, the protrusions 435 are flared to restrict disengagement of a protrusion 435 from a protrusion receiving aperture 525. The curtain rod hanger engaging members may be located at a plurality of positions along the vertical axis 517 and proximate to the lower end 510 of the collar 500.

In an exemplary embodiment, the at least one collar engaging member of the curtain rod hanger 400 includes at least one pair of protrusions 435 extending from the curtain rod hanger 400 in opposite directions from each other and perpendicular to the vertical axis 517. In such an embodiment, the collar 500 may include a pair of protrusion receiving apertures 525 operable to couple the collar to the curtain rod hanger by engaging the pair of protrusions 435.

In the exemplary embodiment, the collar 500 is open at both the upper end 505 and the lower end 510. A lower opening 530 at the lower end 510 facilitates sliding the collar 500 over the upper end 405 of a curtain rod hanger 400. An upper opening 535 at the upper end 505 facilitates extension of the upper end 405 of the curtain rod hanger 400 and/or a curtain rod engaging member through the upper end 505 of the collar 500.

In some embodiments, the collar 500 is configured to accommodate one or more linkages (e.g., a chain and/or a cable) extending from the curtain rod hanger 400. As shown in FIGS. 5 and 6, the base 520 of collar 500 includes linkage channels 540 formed in the base 520 on either side of the protrusion receiving apertures 525. The linkage channels 540 facilitate positioning of the collar 500 over the curtain rod hanger 400 such that the lower opening 530 of the collar 500 is below the linkage engagement member 430 of the curtain rod hanger 400, helping to maintain a position of a chain used therein, as shown in FIG. 7.

A curtain rod hanger 400 and/or a collar 500 may be composed of any material or materials suitable for use with the disclosures provided herein. In an exemplary embodiment, the collar 500 is composed of resilient material (e.g., a flexible plastic), such that the bellows 515 exerts a spring force when compressed and, when removed from the compressive force, substantially returns to its original shape.

In one embodiment, the upper end 505 includes a friction surface 545 having a coefficient of static friction and/or kinetic friction that is higher than a coefficient of friction corresponding to at least a portion of the remainder of the collar 500. Such an embodiment further facilitates preventing unintended contraction of a curtain when the collar is configured such that the bellows 515 compresses the upper end 505 against an overhead track. The friction surface 545 may include a material that is different from the material used to construct at least a portion of the remainder of the collar 500. Alternatively, the friction surface 545 may include a texture (e.g., a scored, pitted, and/or pebbled texture) that produces a higher coefficient of friction than is possessed by the same material with a smooth texture.

FIG. 7 is an illustration of a collar 500 coupled to a curtain rod hanger 400 that is coupled to (e.g., suspended from) an overhead track 110. As shown in FIG. 7, two protrusions 435 of the curtain rod hanger 400 are engaged with two of the protrusion receiving apertures 525 of the collar 500. With the collar 500 coupled to the curtain rod hanger 400, the bellows 515 surrounds at least a portion (e.g., the upper end 405, shown in FIG. 4) of the curtain rod hanger 400. Such embodiments facilitate providing an improved appearance for a curtain hanging system.

In one embodiment, the apparatus shown in FIG. 7 may be assembled by first positioning the collar 500 about the curtain rod hanger 400, such as by sliding the collar 500 over the upper end 405 (shown in FIG. 4) of the curtain rod hanger 400. The curtain rod hanger 400 is attached to an overhead track engaging component, such as shown in FIGS. 2 and 3. The collar 500 is then coupled to at least one collar engaging member (e.g., a protrusion 435) of the curtain rod hanger 400. With the collar 500 so coupled to the curtain rod hanger 400, the bellows 515 may or may not extend to the overhead track 110.

Figure 8:
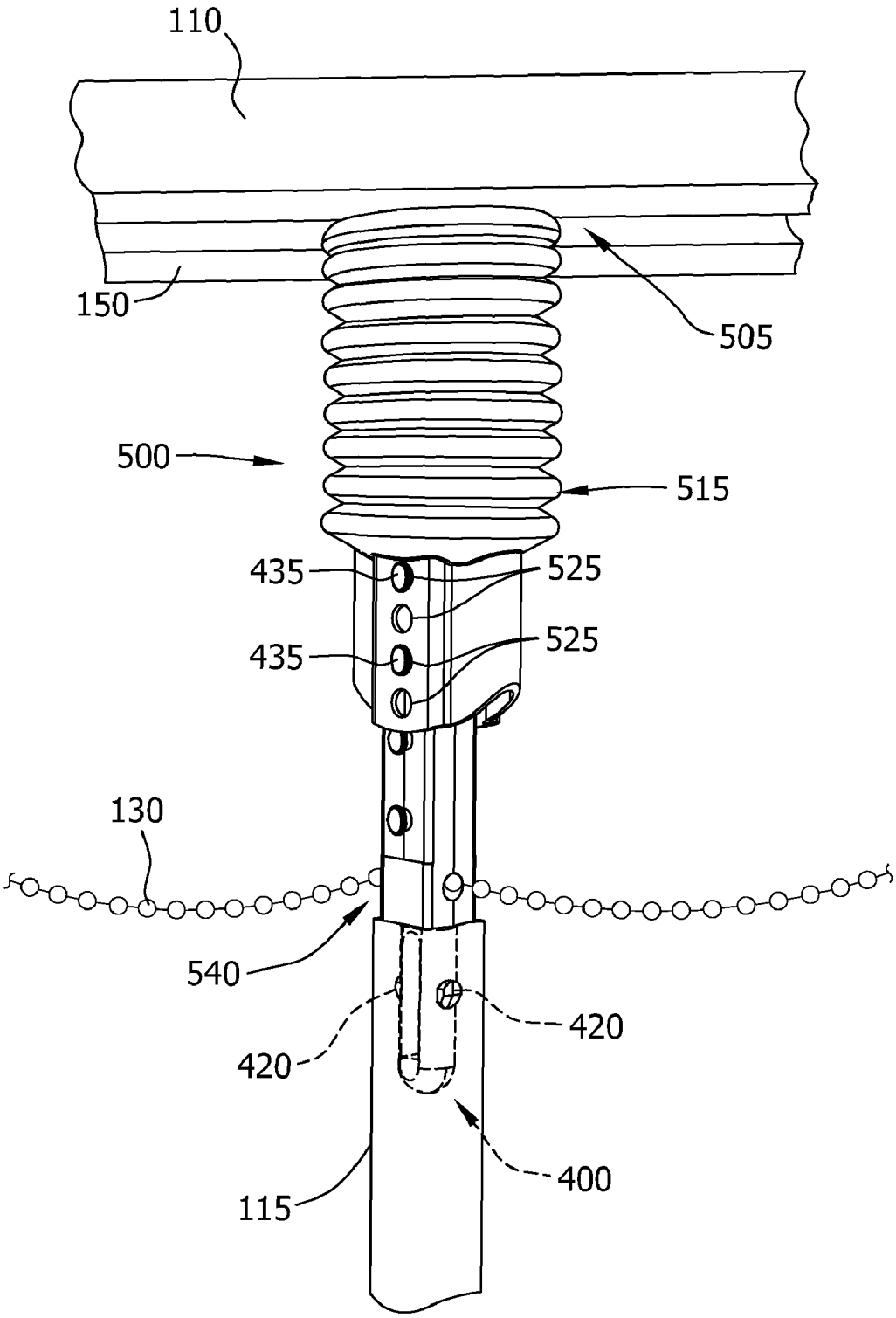
FIG. 8 is an illustration of the collar shown in FIG. 7 compressed against the overhead track.

FIG. 8 is an illustration of the collar 500 compressed against the overhead track 110. As shown in FIG. 8, the protrusion receiving apertures 525 of the collar 500 engage protrusions 435 that are positioned higher on the curtain rod hanger 400 than the engaged protrusions 435 shown in FIG. 7.

With the collar 500 configured as shown, the bellows 515 exert an expansion force. As described above, the collar 500 is coupled to the curtain rod hanger 400. As such, the bellows 515 exert a force on the upper end 505 of the collar against a bottom surface 150 of the overhead track 110. In an exemplary embodiment, this force is substantially normal (e.g., within three or five degrees of normal) to the bottom surface 150. As a result, a frictional force sufficient to resist translation of the curtain rod hanger 400 along the overhead track 110 is generated. To enhance the frictional force, the upper end 505 of the collar 500 may include a friction surface 545 (shown in FIG. 5). In addition, or alternatively, the bottom surface 150 of the overhead track 110 may include a friction surface (not shown).

In an alternative embodiment, the upper end 505 does not extend entirely to the bottom surface 150 or extends approximately to the bottom surface 150 but exerts a force that is insufficient to create a substantial frictional force. In one embodiment, when freestanding, the bellows 515 extends a length approximately equal to or less than a distance between the at least one collar engaging member (e.g., a protrusion 435) and the overhead track 110. In such an embodiment, the curtain rod hanger 400 is allowed to freely translate along the overhead track 110.

Some embodiments facilitate selectively configuring a frictional force for one or more curtain rod hangers in a curtain hanging system. For example, a curtain rod hanger 400/collar 500 combination may utilize at least a first collar engaging member positioned such that the corresponding bellows 515 is compressed between the overhead track 110 and the first collar engaging member. For example, such a compression of the bellows 515 may occur when the curtain rod hanger 400 is coupled to the overhead track engaging component, and the collar 500 is coupled to the first collar engaging member. A separate curtain rod hanger 400 may include one or more other collar engaging members positioned such that the corresponding bellows 515 is not compressed when the curtain rod hanger 400 is coupled to the overhead track engaging component and the collar 500 is coupled to one of the other collar engaging members.

In some embodiments, a first set of curtain rod hangers 400 is fitted with collars 500 such that the bellows 515 of the first set are compressed, and a second set of curtain rod hangers 400 is fitted with collars 500 such that the bellows 515 of the second set are not compressed. For example, the first set may include only the outside (e.g., at the ends of a curtain) curtain rod hangers 400. Such an embodiment facilitates preventing unintended contraction of the curtain while allowing free translation of the curtain rod hangers 400 in the second set.

In some embodiments, a curtain hanging system includes a plurality of curtain rod hangers 400, at least some of which are connected to each other by a linkage 130. With a collar 500 coupled to a curtain rod hanger 400, the linkage 130 may extend through the linkage channel 540 of the collar 500. During rapid movement of a curtain, the linkage 130 may be subjected to erratic forces and/or motions. Even in the presence of such uncontrolled movements, bellows 515 and linkage channel 540 facilitate preventing the linkage 130 from becoming entangled with the curtain rod hanger 400 and/or a curtain rod hanger suspending member.

The above described embodiments address several of the known problems related to the installation and removal of curtains that are attached to a ceiling mechanism. In one aspect, the ease of removal and installation of the curtain is increased as compared to known products. In another aspect, the described operation with respect to installation and removal reduces the exposure of personnel to any contaminants that may be embedded within such curtains.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A curtain hanging system comprising:
a curtain rod hanger comprising:
an upper end having an overhead suspension member operable to couple the curtain rod hanger to a track engaging component;
a lower end opposite the upper end having a curtain rod engaging member; and
at least one collar engaging member; and
a collar comprising:
at least one curtain rod hanger engaging member corresponding to the at least one collar engaging member of the curtain rod hanger and operable to couple the collar to the curtain rod hanger; and
a bellows extending from the curtain rod hanger engaging member, wherein the bellows surrounds at least a portion of the curtain rod hanger when the collar is coupled to the curtain rod hanger.

2. A curtain hanging system according to claim 1, wherein the curtain rod hanger comprises a plurality of collar engaging members.

3. A curtain hanging system according to claim 2, wherein the plurality of collar engaging members are spaced between the upper end of the curtain rod hanger and the lower end of the curtain rod hanger.

4. A curtain hanging system according to claim 2, wherein the plurality of collar engaging members are positioned to allow the collar to be coupled to the curtain rod hanger at a plurality of vertical displacements from the upper end of the curtain rod hanger.

5. A curtain hanging system according to claim 1, wherein the curtain rod hanger is a first curtain rod hanger, the system further comprising:
a second curtain rod hanger; and
a linkage extending from the first curtain rod hanger to the second curtain rod hanger.

6. A curtain hanging system according to claim 5, wherein the collar comprises a linkage channel, wherein the linkage extends through the linkage channel when the collar is coupled to the first curtain rod hanger.

7. A curtain hanging system according to claim 1, wherein the bellows extends from the curtain rod hanger to the track when the collar is coupled to the curtain rod hanger and the curtain rod hanger is coupled to the sliding track.

8. A curtain hanging system according to claim 1, wherein the bellows is operable to exert a force against the track when the collar is coupled to the curtain rod hanger and the curtain rod hanger is coupled to the track.

9. A curtain hanging system according to claim 1, wherein the overhead suspension member comprises at least one hook receiving aperture.

10. A curtain hanging system comprising:
an overhead track engaging component translatably coupled to an overhead track and comprising a curtain rod hanger suspending member;
a curtain rod hanger comprising:
an overhead suspension member corresponding to the curtain rod hanger suspending member and operable to couple the curtain rod hanger to the overhead track engaging component; and
at least one collar engaging member; and
a collar comprising a bellows, wherein the bellows surrounds at least a portion of the curtain rod hanger when the collar is coupled to the curtain rod hanger via the collar engaging member.

11. A curtain hanging system according to claim 10, wherein the curtain rod hanger further comprises a curtain rod engaging member operable to couple the curtain rod hanger to a substantially vertical curtain rod.

12. A curtain hanging system according to claim 10, wherein the bellows extends a length when freestanding, the length approximately equal to or less than a distance between the at least one collar engaging member and the overhead track.

13. A curtain hanging system according to claim 10, wherein the collar comprises:
an upper end associated with the bellows; and
a lower end opposite the upper end,
wherein the collar engaging member is operable to couple the curtain rod hanger to the lower end of the collar.

14. A curtain hanging system according to claim 13, wherein the upper end and the lower end of the collar define a vertical axis, and the collar further comprises a plurality of curtain rod hanger engaging members at a plurality of positions along the vertical axis and proximate to the lower end, the curtain rod hanger engaging members corresponding to the at least one collar engaging member of the curtain rod hanger.

15. A curtain hanging system according to claim 13, wherein:

the upper end and the lower end of the collar define a vertical axis;

the at least one collar engaging member comprises a pair of protrusions extending from the curtain rod hanger in opposite directions perpendicular to the vertical axis; and the collar comprises a pair of protrusion receiving apertures operable to couple the collar to the curtain rod hanger by engaging the pair of protrusions.

16. A curtain hanging system according to claim 10, wherein the curtain rod hanger further comprises a plurality of overhead suspension members operable to couple the curtain rod hanger to the overhead track engaging component at a plurality of vertical distances from the overhead track.

17. A curtain hanging system according to claim 10, wherein the curtain rod hanger further comprises:

an upper end comprising the overhead suspension member; and a lower end opposite the upper end and comprising a plurality of collar engaging members at a plurality of positions along a vertical axis defined by the upper end and the lower end.

18. A curtain hanging system according to claim 17, wherein a first collar engaging member of the plurality of collar engaging members is positioned such that the bellows is compressed between the overhead track and the first collar engaging member when the curtain rod hanger is coupled to the overhead track engaging component and the collar is coupled to the first collar engaging member.

19. A method of assembling a curtain hanging system, the curtain hanging system comprising a curtain rod hanger having an upper end, a lower end, and a plurality of collar engaging members at a plurality of positions between the upper end and the lower end, the method comprising:

positioning a collar about the curtain rod hanger, the collar having a bellows;

attaching the curtain rod hanger to a track engaging component that is translatably coupled to a track; and coupling the collar to a first collar engaging member of the plurality of collar engaging members such that the bellows extends to the track.

20. A method according to claim 19, further comprising coupling the collar to the first collar engaging member such that the bellows exerts a force against the track sufficient to restrict translation of the track engaging component along the track.

* * * * *